US006918800B2

(12) United States Patent
Ota et al.

(10) Patent No.: US 6,918,800 B2
(45) Date of Patent: Jul. 19, 2005

(54) ARC RESISTANT TERMINAL, ARC RESISTANT TERMINAL PAIR AND AUTOMOTIVE CONNECTOR

(75) Inventors: Koji Ota, Mie-gun (JP); Hiroki Hirai, Nagoya (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/697,087

(22) Filed: Oct. 31, 2003

(65) Prior Publication Data

US 2004/0137772 A1 Jul. 15, 2004

(30) Foreign Application Priority Data

Nov. 5, 2002 (JP) ..... 2002-321240

(51) Int. Cl.[7] ..... H01R 9/24
(52) U.S. Cl. ..... 439/886; 439/181
(58) Field of Search ..... 439/886, 887, 439/181

(56) References Cited

U.S. PATENT DOCUMENTS 4,100,385 A * 7/1978 Wutz ..... 200/268
4,747,783 A * 5/1988 Bellamy et al. ..... 439/59
4,925,394 A * 5/1990 Hayashi et al. ..... 439/86
5,236,789 A * 8/1993 Cowie et al. ..... 428/670
6,537,092 B2 * 3/2003 Hirai et al. ..... 439/181
6,572,420 B2 * 6/2003 Lawrence ..... 439/887
6,623,288 B2 9/2003 Sakiyama et al.
2001/0024895 A1 * 9/2001 Sakiyama et al. ..... 439/181
2002/0064986 A1 * 5/2002 Hirai et al. ..... 439/181

* cited by examiner

*Primary Examiner*—Ross Gushi
(74) *Attorney, Agent, or Firm*—Oliff & Berridge, PLC

(57) ABSTRACT

A terminal to be electrically connected with an other terminal at a contact portion thereof by being engaged with the other is formed such that at least an outer-surface part of a final contact portion thereof which is separated last from the other terminal upon separating this terminal from the other terminal is made of an are resistant material mainly containing Ti. Thus, there can be provided an arc resistant terminal, an arc resistant terminal pair and an automotive connector provided with such a terminal which can effectively suppress an occurrence of an arc discharge even in such a condition that a base metallic material of the terminal creates an arc discharge.

16 Claims, 7 Drawing Sheets

ARC RESISTANT TERMINAL, ARC RESISTANT TERMINAL PAIR AND AUTOMOTIVE CONNECTOR

BACKGROUND OF THE INVENTION

1. Field of the Invention

The present invention relates to an arc resistant terminal and an arc resistant terminal pair used for electrical connection in the application of a high voltage in an automotive vehicle or the like and an automotive connector (e.g. a connector, a joint box) provided with such a terminal.

2. Description of the Related Art

Connectors used in an automotive vehicle or the like may be detached with a frequency of about once every several months or once every several years for the maintenance and inspection of the automotive vehicle or the like. However, there is a danger of creating an arc discharge between the terminals of the connector the moment they are separated. Particularly, in recent years, a progress has been made to further increase a battery voltage to about DC36V instead of confining it to about DC12V of conventional use. Thus, there is a danger of creating a fairly large arc. The terminals are thought to be damaged due to such an arc. For example, a male terminal is normally bar-shaped or plate-shap d, and has its leading end portion slightly pointed in order to facilitate the insertion into a female terminal. The pointed leading end portion is fused by the repeated connection and separation of the male terminal with and from the female terminal and the accompanying repeated occurrence of the arc discharge, and a fused part is cooled and solidified after slightly moving toward a base end of the male terminal. Thus, the leading end portion becomes round and bulges out. In other words, there is a possibility that the terminal is considerably deformed, which may result in a contact failure and may, in a worst case, make the male terminal fitting unable to be inserted into the female terminal.

As a measure to avoid such an inconvenience caused by the arc discharge. Japanese Unexamined Patent Publication No. 2001-266985 (pages 2 to 4) discloses a male terminal in which a resistance element unlikely to create an arc discharge is attached to the outer surface of a leading end portion of a conductive plate forming the male terminal, and the conductor plate is in contact with a female terminal when the male terminal is completely connected with the female terminal, whereas the resistance element is separated last from the female terminal when the two terminals are separated, thereby suppressing an occurrence of an arc discharg in the moment of separating the male and female terminals.

The above publication discloses the use of carbon and tungsten as the resistance element. However, for example, tungsten creates an arc discharge with a power supply voltage DC of a circuit=36V and a current between terminals=30A. Thus, tungsten cannot be used for terminals used in an environment whose voltage and current are to be further increased in the future. In the case of using carbon as the resistance element, adherence to the conductive plate is low and such a resistance element may come off the conductive plate to expose the conductive plate. Therefore, there has been a demand for a measure to more securely suppress an occurrence of an arc discharge.

SUMMARY OF THE INVENTION

In view of the above problems, an object of the present invention is to provide an arc resistant terminal and an arc resistant terminal pair capable of effectively suppressing an occurrence of an arc discharge even in such a high voltage/high current condition as to create an arch discharge, and an automotive connector provided with such a terminal.

The present invention is directed to an arc resistant terminal to be electrically connected with an other terminal at a contact portion th r of by being engaged with the other terminal, wher in at l ast an uter-surface part of a final contact portion of the arc resistant terminal is made of an arc resistant material mainly containing titanium, provided that the final contact portion means a portion which is separated last from the other terminal upon separating the arc resistant terminal from the other terminal.

Generally, an occurrence of an arc discharge can be suppressed by making the final contact portion of one terminal of the arc resistant material mainly containing titanium since the arc discharge occurs when the final contact portion of the one terminal is separated (fitted into) from the other terminal.

The titanium content of the arc resistant material is preferably 95 mass % or higher because a better are resistance can be obtained by increasing the purity of the titanium content. However, the arc resistant material mainly containing titanium may reduce the electrical conductivity of the terminal as a whole since having a low electrical conductivity. Accordingly, it is preferable that a base material of the terminal is any one of copper, a copper alloy, aluminum, an aluminum alloy and a like material having a high electrical conductivity. Further, when the arc resistant terminal is connected with the other t rminal, a part thereof mad of the base mat rial is preferably in contact with the other terminal for the electrical connection. Further preferably, the arc resistant terminals may be used as an arc resistant terminal pair including a male terminal and a female terminal connectable with each other, wherein the final contact portions of the two terminals are separated from each other upon separating the two terminals. Furthermore, the arc resistant terminal may be preferably used in an automotive connector.

These and other objects, features and advantages of the present invention will become more apparent upon a reading of the following detailed description and accompanying drawings.

DESCRIPTION OF THE PREFERRED EMBODIMENTS OF THE PRESENT INVENTION

Figure 1:
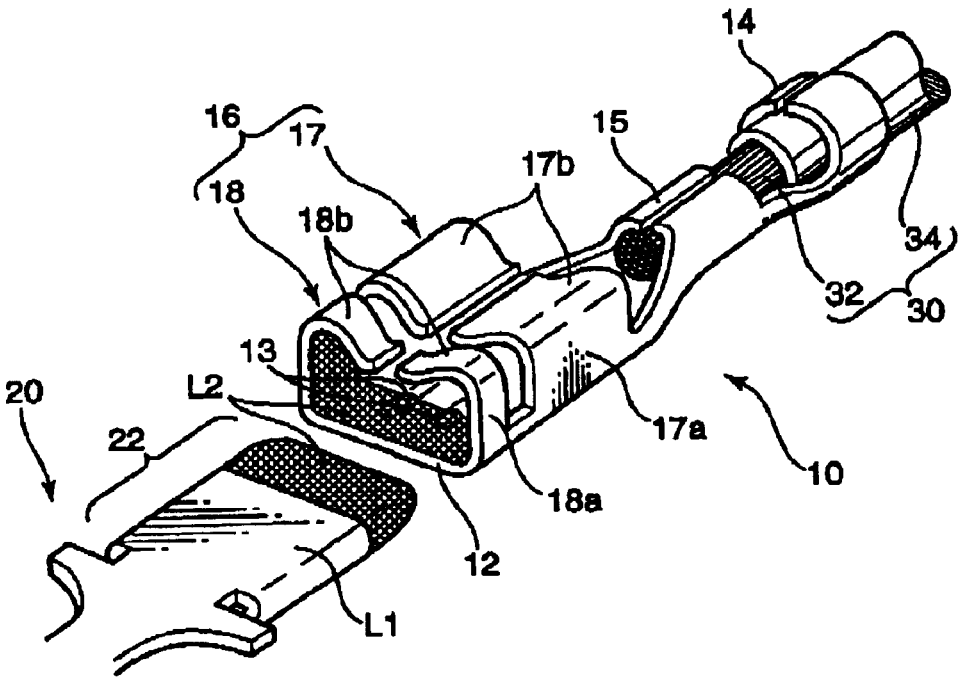
FIG. 1 is a schematic perspective view showing a terminal pair according to one embodiment of the invention.

The inventive arc resistant terminal is a terminal to be electrically connected with the other terminal at its contact portion upon being connected with the other terminal, and characterized in that at least the outer-surface part of the final contact portion is made of the arc resistant material. Specifically, since the arc discharge ccurs when the one terminal is separated from (fitted into) the other terminal, attention is paid to a final contact portion of an electrical contact portion of one terminal. Herein, the electrical contact portion is a portion of the terminal, which is connected with the other terminal when the one and the other terminals are connected. The final contact portion is a part of the electrical contact portion, and means the portion which is separated last from the other terminal when separating the arc resistant terminal from the other terminal. If at least the outer-surface part of such a final contact portion is made of the material having a good arc resistance and mainly containing titanium, an occurrence of the arc discharge can be suppressed. It is sufficient to make at least the outer-surface part of the final contact portion of the arc resistant material: parts of the final contact portion other than its outer-surface part may also be made of the arc resistant material. For example, if the final contact portion is a layer having a specified thickness and present on the outer surface of the electrical contact portion of the terminal, not only the outer surface of the final contact portion, but also the entire layer may be made of the material mainly containing titanium. In the present invention, it is sufficient that at least the final contact portion is made of the arc resistant material, and a part (hereinafter, may also be referred to as "electrical contact portion main body") of the electrical contact portion other than the final contact portion may also be made of the arc resistant material. Even in such a case, an occurrence of the arc discharge can be suppressed if the final contact portion is made of the arc resistant material. However, it to not preferable to make the entire electrical contact portion of the arc resistant material since the electrical conductivity of the terminal as whole is reduced. Thus, in the present invention, it is preferable that the final contact portion made of the arc resistant material is locally provided in the electrical contact portion of the terminal, thereby allowing the electrical contact portion main body to be in contact with a contact part of the other terminal for the electrical connection when this terminal is engaged with the other terminal.

Next, the arc resistant material forming the final contact portion is described. The arc resistant material is not particularly restricted provided that it mainly contains titanium. It is desirable that the titanium content of the arc resistant material is 95 mass % or higher, preferably 99 mass % or higher, or more preferably 99.5 mass % or higher. As described later, the arc resistant material mainly containing the titanium has such a charact ristic that no arc discharge occurs even in a very strict condition that an inter-terminal voltage is 36V and an inter-terminal current is 40 to 60A.

The base material of the inventive terminal is not particularly restricted, but is preferably a material having a high electrical conductivity. Since the arc resistant material forming the final contact portion may reduce the electrical conductivity of the terminal as a whole as described above, a reduction of the electrical conductivity of the terminal as a whole can be suppressed if the material having a high electrical conductivity is used as the base material of the terminal.

For example, copper (pure copper), a copper alloy, aluminum (pure aluminum), an aluminum alloy or the like can be used as the base material of the terminal. This base material is preferably copper (pure copper) or a copper alloy. It should be noted that the pure copper and the pure aluminum are so-called industrial pure copper and pure aluminum and may contain unavoidable impurities.

The copper alloy is not particularly restricted provided that it is generally used as a terminal material. It may be a Cu—Mg—P alloy, a Cu—Fe—P alloy, a Cu—Sn alloy, a Cu—Sn—Fe—P alloy, a Cu—Zn alloy or the like. For example, following copper alloys may be used.

(1) Sn: 1.8 to 2.2 mass %, Fe: 0.05 to 0.15 mass %, P: 0.025 to 0.04 mass %, remaind r: Cu and unavoidabl impurities (2) Ni: 1 mass % or lower, Sn: 0.9 mass % or lower, P; 0.05 mass % or lower, remainder: Cu and unavoidable impurities (3) Sn: 1.7 mass % or lower. Fe: 0.15 mass % or lower, Zn: 0.1 mass % or lower, P: 0.05 mass % or lower, remainder: Cu and unavoidable impurities (4) Sn: about 6 mass % or lower, P; 0.06 mass % or lower, remainder: Cu and unavoidable impurities (5) Ag: 0.6 mass % or lower, P: 0.06 mass % or lower, remainder: Cu and unavoidable impurities (6) Mg: 0.7 mass % or lower, Ps 0.005 mass % or lower, remainder: Cu and unavoidable impurities (7) Be: 2 mass % or lower, P: 0.06 mass % or lower, remainder: Cu and unavoidable impurities (8) Zn: 5 to 40 mass %, remainder: Cu and unavoidable impurities The aluminum alloy may, for example, be an Al—Cu alloy, an Al—Si alloy, an Al—Cu—Si alloy or the like.

Hereinafter, the present invention is described in detail with reference to the accompanying drawings, but is not limited to an illustrated embodiment. FIG. 1 is a schematic perspective view showing a case where arc resistant terminals of the present invention are used as a female terminal 10 and a mal terminal 20 which are automotive connector terminals. The female terminal 10 is integrally formed with a bottom wall 12 extending in forward and backward directions, an insulation barrel 14, a conductor barrel 15 and a terminal connecting portion 16 which are successively arranged along the bottom wall 12 from the rear side. A pair of left and right elongated projections 13 project upward from the upper surface of the bottom wall 12. The respective elongated projections 13 extend backward by a specified length from a position slightly distanced backward from the leading end face of the bottom wall 12 to support the male terminal 20 (more specifically male tab 22) to be inserted into the female terminal 10 from below.

Each of the insulation barrel 14 and the conductor barrel 15 includes a pair of left and right holding pieces extending from the left and right edges of the bottom wall 12, and is mounted on an end of an insulated wire 30 in which a conductor 32 is covered by an insulation coating 34 as shown in FIG. 1. Specifically, the conductor barrel 15 is crimped to tightly hold a conductor 32 exposed at the end of the insulated wire 30 from outer sides, whereas the insulation barrel 14 is crimped to tightly hold the insulation coating 34 from outer sides. The tab 22 of the mating male terminal 20 is fitted from its leading end into the terminal connecting portion 16, which is divided into a terminal leading end portion 18 and a t rminal main body 17 arranged behind the leading end portion 18.

On the other hand, the male terminal 20 includes an insulation barrel and a conductor barrel (not shown) completely similar to the insulation barrel 14 and the conductor barrel 15 of the female terminal 10, and the plate-shaped tab 22 is formed at the leading end thereof.

In this embodiment, the terminal connecting portion 16 of the female terminal 10 and the tab 22 of the male terminal 20 form electrical contact portions. Upon separating the male terminal 20 from the female terminal 10, a portion of the female terminal 10 which is separated last, i.e. the inner side (hatched portion) of the leading end portion 18 of the female terminal 10 serves as a final contact portion, and such a final contact portion is made of an arc resistant material mainly containing titanium (Ti). In the male terminal 20, the leading end portion (hatched portion) of the tab 22 serves as a final contact portion, which is made of an arc resistant material mainly containing Ti.

Figure 2A:
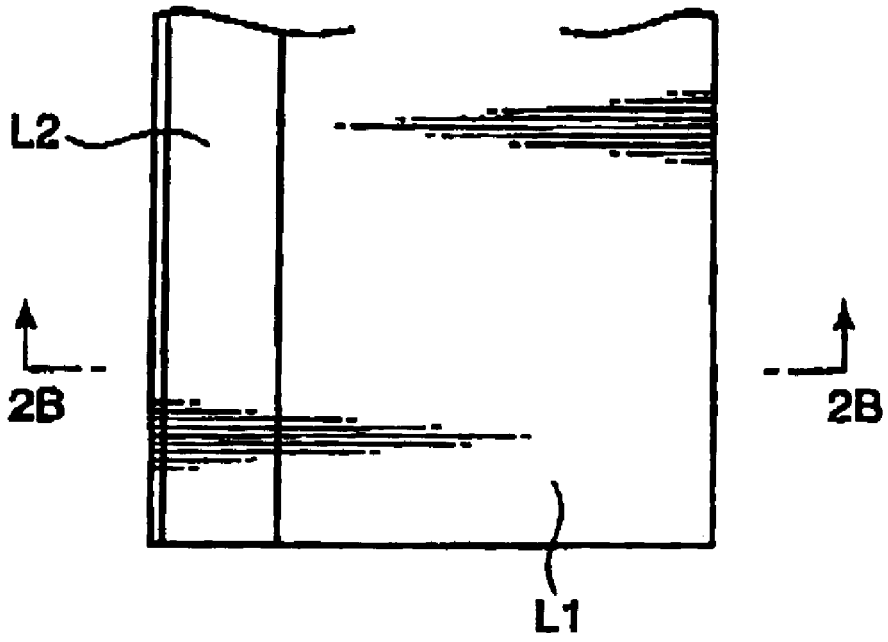
FIG. 2A is a plan view showing a stripe clad material as a material for a male and a female terminals of the terminal pair, and FIG. 2B in a section along 2B—2B of FIG. 2A.
Figure 2B:
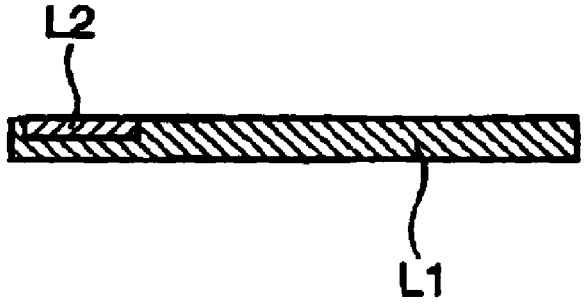

Both terminals 10, 20 can be formed by bending stripe clad materials as shown in FIG. 2 stamped out into suitable shapes. This stripe clad material is formed by placing a strip-shaped layer L2 made of the arc resistant material mainly containing Ti (h reinaft r, mer ly "arc resistant layer") along an edge in a partial ar a (area quite close to one lateral end of an conductive layer L1 in a shown example) of the conductive layer L1 made of a conductive material, and making the two layers L1, L2 integral to each other by rolling, hot hydrostatic extrusion, or a like means. For example, a titanium stripe clad material containing pure copper or a copper alloy as a conductive material is preferably used as the stripe clad material. In the present invention, specific thicknesses of both layers L1, L2 can be suitably set, wherein both layers may have the same thickness or the layer L2 made of the arc resistant material may be thinner than the conductive layer L1. Generally, it is sufficient to set the thicknesses of the respective layers within a range of, e.g. 0.1 to 0.2 mm.

Both terminals 10, 20 are formed by stamping the stripe clad material such that a portion thereof where the arc resistant layer L2 is placed (hatched portion in FIG. 1) cones to be located at the final contact portion of the terminal and bending the stamped-out stripe clad material.

Figure 3:
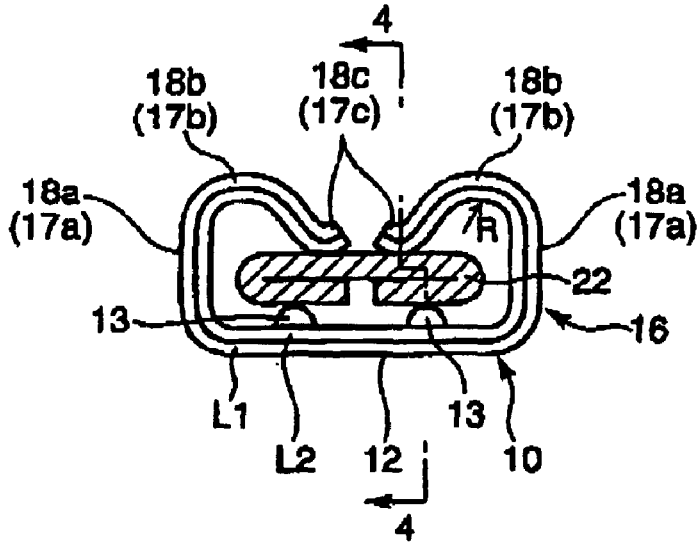
FIG. 3 is a front view in section showing a connected state of the terminal pair when viewed from the leading end f the femal t rminal.
Figure 4:
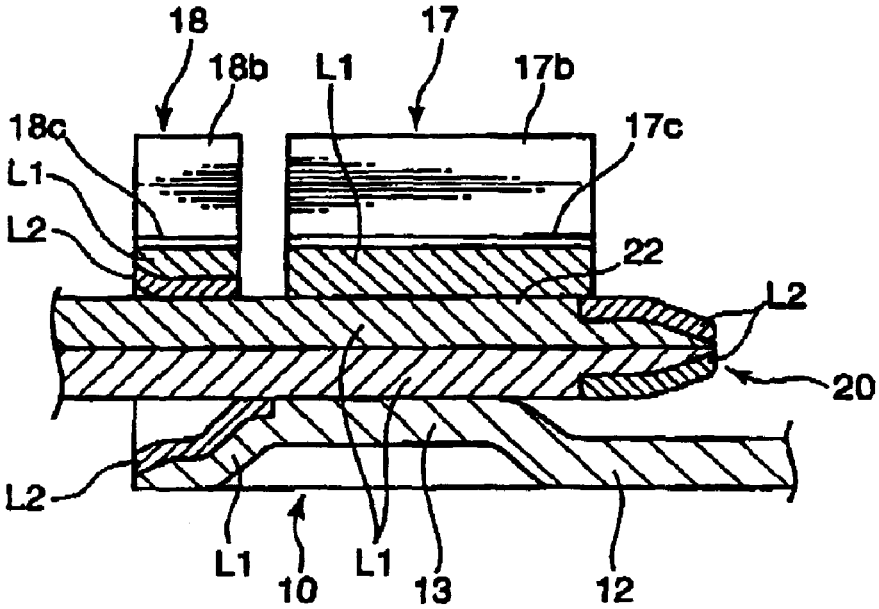
FIG. 4 is a s ction along 4—4 of FIG. 3.

FIG. 3 is a front view in section showing a connected state of the two terminals when viewed from the leading end of the female terminal 10, and FIG. 4 is a section along 4—4 of FIG. 3. As shown in FIG. 3, the arc resistant layer L2 mainly containing Ti is provided at the inner side of the leading end portion 18 in the female terminal 10. The female terminal 10 is integrally formed with standing walls 18*a* (17*a*) standing up from the opposite left and right edges of the bottom wall 12 and elastic pieces 18*b* (17*b*) extending obliquely inward toward the bottom from the upper ends of the respective standing walls 18*a* (17*a*). Leading end portions 18*c* (17*c*) of the respective elastic places 18*b* (17*b*) are turned in a direction (upward in the shown example) away from the male terminal 20 (more specifically tab 22) to be fitted into the terminal connecting portion 16, and parts (downward-projecting parts located at bottommost positions) of the leading end portions 18*c* (17*c*) slightly distanced toward the base ends from the leading end faces come into contact with the tab 22 of the male terminal 20. A radius of curvature R (see FIG. 3) of bent portions between the standing wall portions 18*a* (17*a*) and the elastic pieces 18*b* (17*b*) is set at such a large value as not to cause any crack in the arc resistant layer L2.

Further, as shown in FIG. 4, the arc resistant layer L2 is provided on the end inner surface of the bottom wall 12 and the leading end portion 11 of the female terminal 10 at the opening side. The end inner surface at the opening side is so slanted as to widen the opening toward the front end by so-called angular striking (or by bending).

The tab 22 of th mal t rminal 20 is formed by folding back the left and right sides of a wider part of the stamped-out stripe clad material substantially by 180° such that the arc resistant layer L2 is located at the outer side of the conductive layer L1, and has twice the thickness of the clad material. This thickness in slightly larger than a vertical distance between the terminal contact portions (downward-projecting parts of the leading end portions 17*c*, 18*c* located at the bottommost position of the female terminal) and the elongated projections 13 in a state where the leading end portion 18 and the terminal main body 17 are not elastically deformed.

The tab 22 has a length sufficiently longer than the width of the layer L2 made of the arc resistant material (see FIG. 1). Accordingly, in this tab 22, the arc resistant layer L2 is formed only at the leading end and a part thereof behind the arc resistant layer L2 forms an electrical contact portion main body (conductive layer L1). With the terminals 10, 20 completely connected with each other, the electrical contact portion main body (conductive layer L1) of the tab 22 and that of the female terminal 10 are directly in contact to establish an electrical connection (see FIG. 4). Further, as shown in FIG. 4, the arc resistant layer L2 located at the outer surface of the leading end portion of the tab 22 is so tapered by a so-called angular striking treatm nt that the thickness of the leading end portion f the tab 22 gradually decreases to its leading end. By such a treatment, the conductive layer L1 can be prevented from being exposed at the leading end portion of the tab 22.

Figure 5:
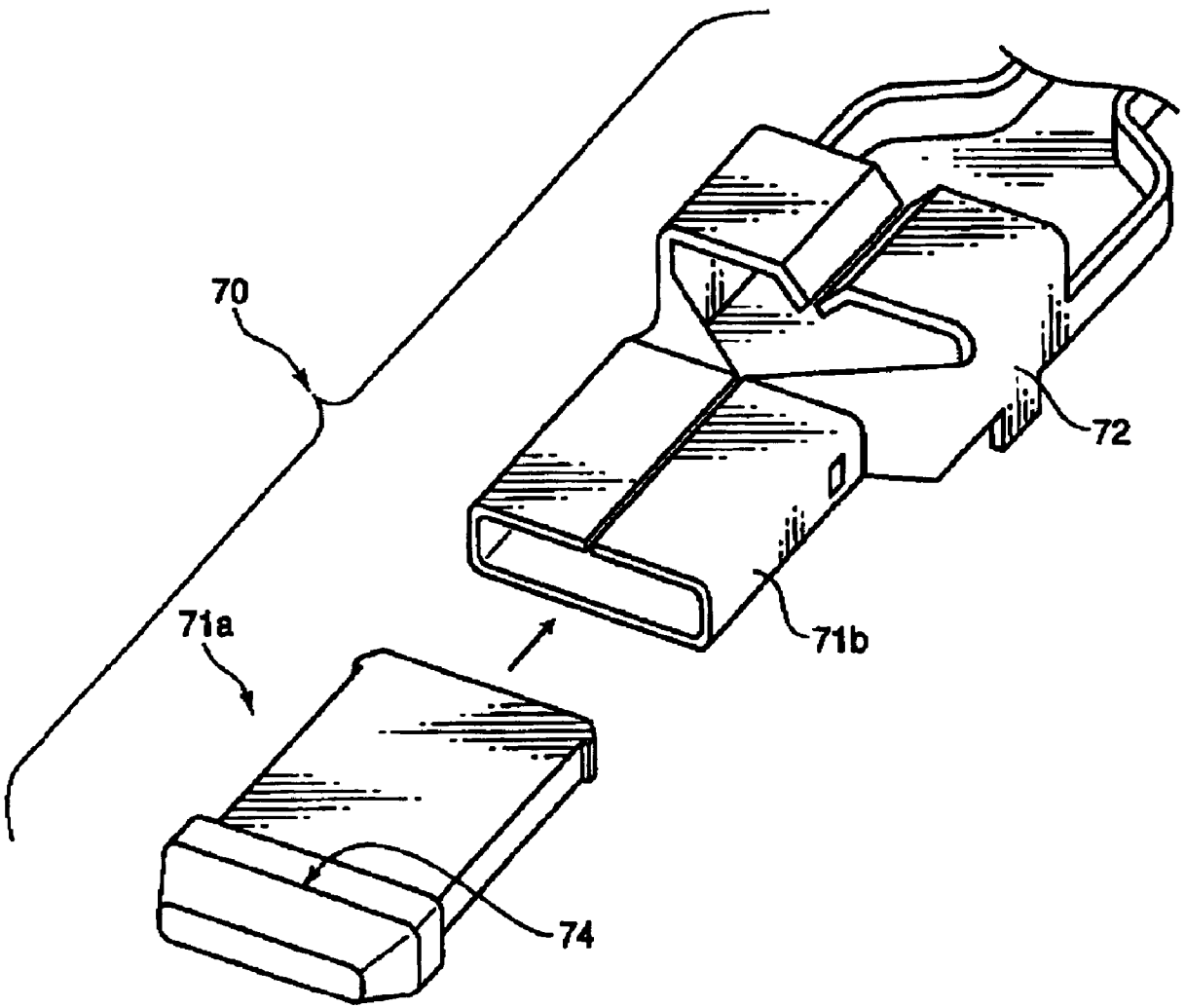
FIG. 5 is a schematic perspective view showing another example of the male terminal according to the invention.

In the present invention, the tab 22 needs not be integral to the main body of the male terminal 20 and may, for example, be a detachable separate part. In such a mode, for example, the detachable separate part is entirely or partly made of the arc resistant material mainly containing Ti. FIG. 5 is a schematic perspective view showing another example of the male terminal according to the present invention, wherein a main body 72 and a tab 22 (identified by 71*a* in FIG. 5) of a male terminal 70 are separate parts. In the mode of FIG. 5, the detachable tab 22 (71*a*) in made of the arc resistant material mainly containing Ti and can be incorporated into the terminal main body 72 by being fitted into an electrical contact portion main body 71*b* substantially in the form of a tube and crimping this tube-shaped main body 71*b*. In this embodiment, a leading end portion 74 of the tab 22 (71*a*) forms a final contact portion of the male terminal 70 to suppress an occurrence of an arc discharge, and the electrical contact portion main body 71*b* comes into contact with the electrical contact portion of the female terminal 10 to be electrically connected therewith. Although the tab 22 (71*a*) is made of th arc resistant material mainly containing Ti in the mode of FIG. 5, only the leading end portion 74 thereof may, for example, be made of each an arc resistant material. In either case, the final contact portion of the male terminal 70 is made of the arc resistant material mainly containing Ti.

A method for producing the inventive arc resistant terminal is not particularly restricted. As mentioned above, a method according to which the clad material made up of the arc resistant material mainly containing Ti and the conductive material is stamped out into a specified terminal shape and bent such that the final contact portion of the terminal is made of the are resistant material mainly containing Ti: and a method according to which a part (tab) made of the arc resistant material mainly containing Ti is used and engaged with a base material of the electrical contact portion such that this part (tab) becomes the final contact portion. A surface treatment such as tin (Sn) plating may be applied to the outer surfaces of the arc resistant terminal and the arc resistant terminal pair according to the present invention. The surface treatment such as Sn plating may be applied to the entire outer surface of the electrical contact portion or the outer surface of the electrical contact portion main body (outer surface of the electrical cont ct portion excluding the final contact porti n). The thickness of the surface treatment layer such as Sn plating layer is normally about 5 $\mu$m or smaller because the Sn plating layer or the like of this thickness does not affect the arc discharge.

The inventive arc resistant terminal may be applied, for example, an a male terminal and a female terminal connectable with each other, which are used as an arc resistant terminal pair. The inventive are resistant terminal is applied, for example, to automotive connectors such as electrical connection boxes (joint boxes, etc.) provided with connector portions, relays and motors provided with connector portions for the connection with external circuits. It should be noted that the connector portions for the connection with external circuits may be incorporated into main bodies of relays, motors and the like.

Figure 6:
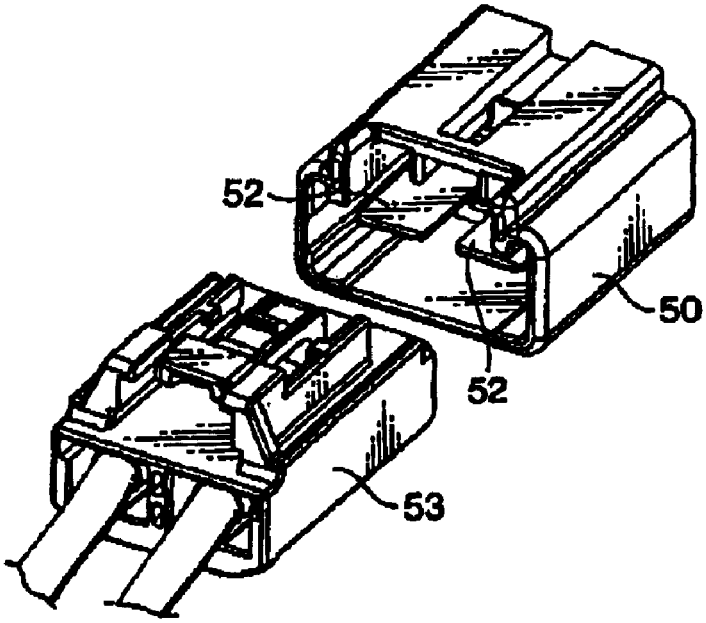
FIG. 6 is a schematic perspective view showing one example of a connector according to the invention.

FIG. 6 is a schematic perspective view showing a connector assembly according to the present invention. Specifically, a male terminal provided with a plurality of (two in this example) male tabs 52 (male electrical contact portions) is accommodated in one connector 50, whereas a female terminal connectable with the male terminal and provided with a plurality of female electrical contact p rtions is accommodated in the other c nnector 53. The connectors 50, 53 ar also connected as the male and femal terminals are connected. In such a connector assembly as well, a good arc suppressing effect can be obtained by using the inventive terminal as at least one (preferably both) of the male and female terminals.

Figure 7:
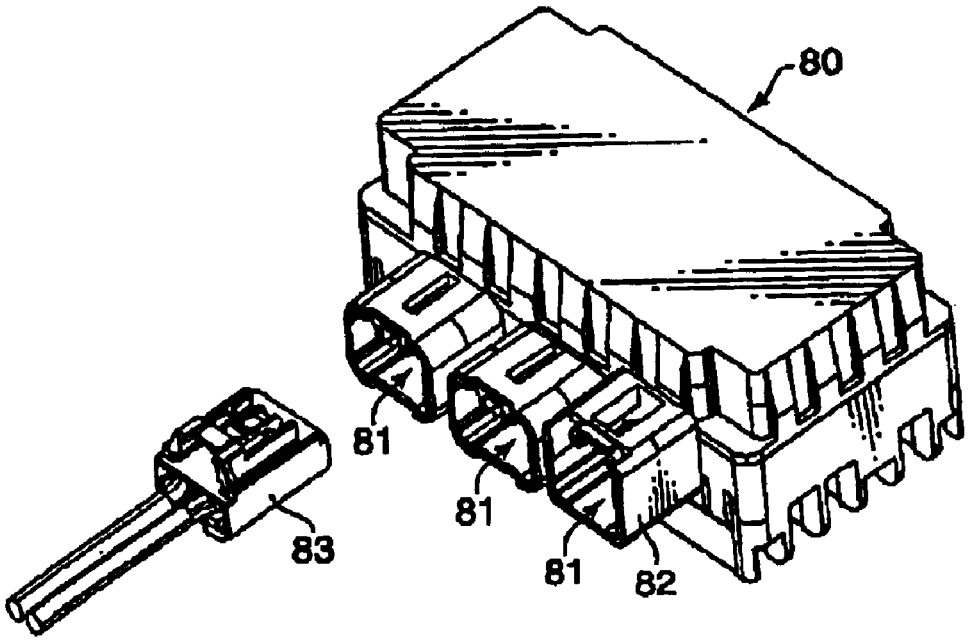
FIG. 7 is a schematic perspective view showing one example of an electrical connection box according to the invention.
Figure 8:
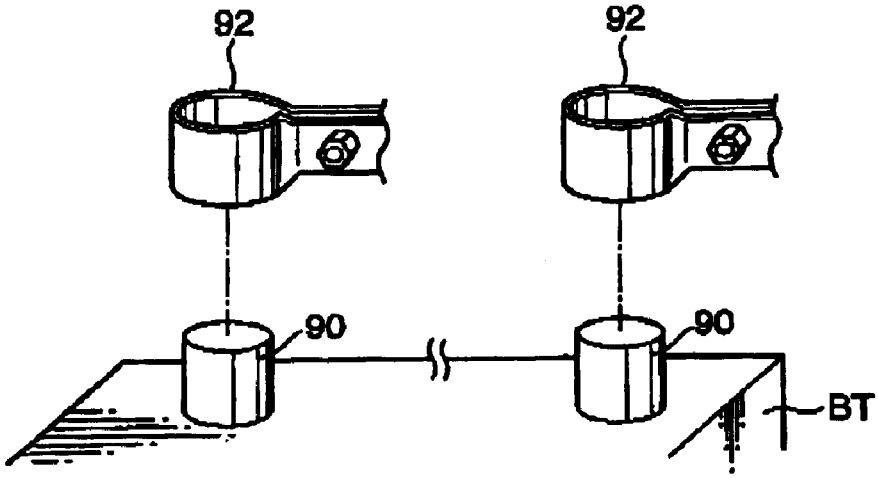
FIG. 8 is a partial perspective view enlargedly showing a battery terminal according to the invention.

FIG. 7 is a schematic perspective view showing one example of an electrical connection box according to the present invention. In an electrical connection box 80 of this embodiment, a busbar arranging portion is accommodated, and a plurality of (three in this example) connector portions 81 which are in contact with the busbar arranging portion and exposed to outside are provided. Each connector portion 81 is accommodated in a hood 82 which is formed on a casing of the electrical connection box 80 and into which terminals project from the busbar arranging portion. In such an electrical connection box as well, a good arc suppressing effect can be obtained by using the inventive terminal as at least either terminals of the connector portions 81 or those of connectors 83 (preferably as both). FIG. 8 is a schematic perspective view showing a case where the inventive arc resistant terminals are used as battery terminals. A good arc suppressing effect can be obtained by using the inventive terminal as at least either battery connecting terminals 92 or electrode terminals 90 of a battery (preferably as both).

Figure 9:
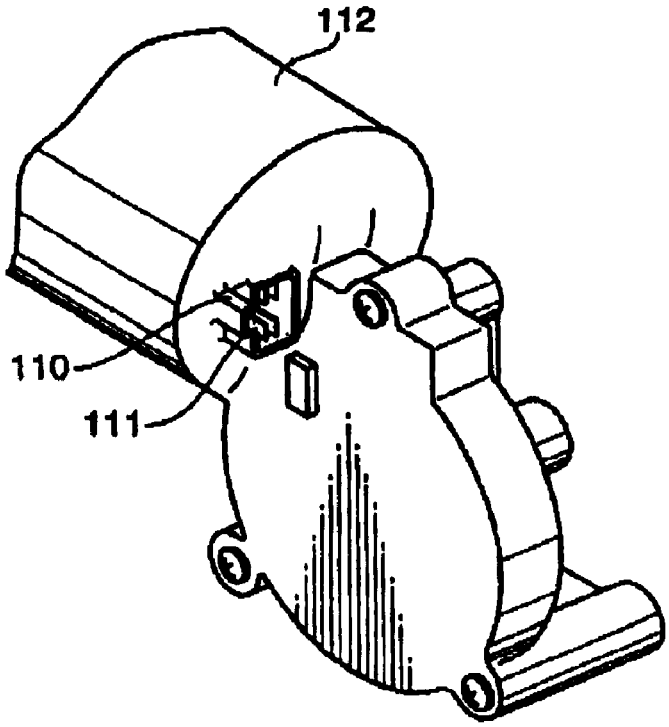
FIG. 9 is a schematic perspective view showing a mode in which the inventive terminal is used in a connector portion provided in a motor.

FIG. 9 is a schematic perspective view showing a case where the inventive arc resistant terminal is used in a motor having a connector portion 110 for the connection with an external circuit. The connector portion 110 is incorporated into a motor main body 112 in this mode, wherein the inventive arc resistant terminal can be suitably used as terminals 111 of the connector portion 110.

The arc resistant terminal, the arc resistant terminal pair and the automotive connector according to the present invention are not particularly restricted. However, they are suitably used in an application in which an inter-terminal voltage immediately after the separation of the terminals (may be called merely "inter-terminal voltage") is DC12V to 60 V (preferably, 24V to 60V, more preferably 36V to 42V) and an inter-terminal current during the contact (may be called merely "inter-terminal current") is 5A to 60A (preferably 30A to 60A, more preferably 40A to 50A), more preferably in an application in which the inter-terminal voltage is DC36V(±1V) and the inter-terminal current is 5A to 60A (preferably 30A to 60A, more preferably 40A to 60A). Numerical ranges of the inter-terminal voltage and the inter-terminal current may be suitably selected depending on the kind of the bas material of the electrical contact portion main body of the terminal. For example, in a terminal using a brass (Cu/Zn) as a base material of an electrical contact portion main body thereof, an arc discharge occurs even in the case that the inter-terminal voltage is DC36V(±1V) and the inter-terminal current is 10A. Further, in a terminal using copper or a copper alloy as a base material of an electrical contact portion main body thereof, an arc discharge occurs in the case that the inter-terminal voltage is DC36V(±1V) and the inter-terminal current is 40A to 60A. In either case, an occurrence of the arc discharge can be effectively suppressed if a final contact portion in made of an arc resistant material mainly containing Ti. A separating speed of the terminals is not particularly restricted. An occurrence of the arc discharge can be securely suppressed, for example, if the separating speed lies within a range of about 30 to 600 mm/min. (particularly about 40 to 550 mm/mm.).

EXAMPLES

The following examples illustrate the present invention, however these examples are intended to illustrate the invention and are not to be construed to limit the scope of the present invention. Many variations and modifications of such examples will exist without departing from the scope of the inventions. Such variations and modifications are intended to be within the scope of the invention.

EXAMPLE 1

Figure 10:
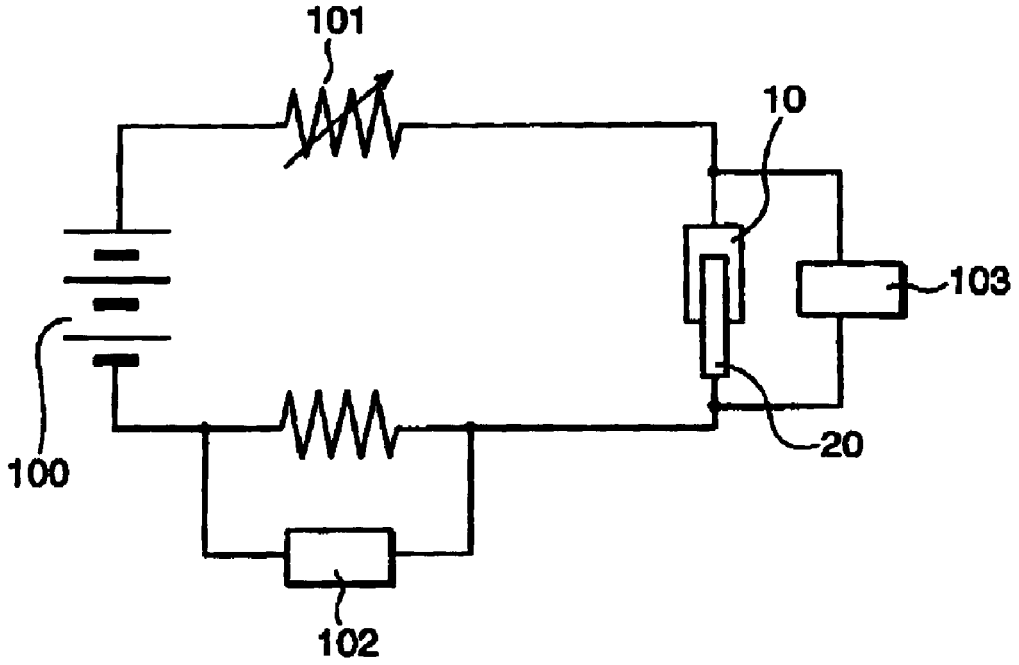
FIG. 10 is a circuit diagram of an experiment for an arc discharge resisting property.

Are Discharge Resisting Property of the Arc Resistant Material Mainly Containing Ti Two round bar-shaped terminal models (diameter: about 2.3 mm) made of Ti (purity of 99.5 mass % or higher) were used. These two terminals were separated at a separating speed of 100 mm/min. in a condition that the inter-terminal voltage is DC36V and the inter-terminal current is 40A to 60A, and an occurrence of an arc discharge was confirmed by a circuit shown in FIG. 10. Specifically, the male terminal 20 and the female terminal 10 were brought into contact (connected) with each other to be connected with a battery 100, a variable resistor 101 is provided between the battery 100 and the terminals 10, 20 to control a current amount flowing through the circuit. The current amount flowing through the circuit was made measurable by providing a shunt resistor (standards: 50 mV/50A) between the battery 100 and the two terminals 10, 20 and providing an oscilloscope 102 in parallel with the shunt resistor. The inter-terminal voltage was made measurable by providing an oscilloscope 103 in parallel with the two terminals 10, 20. A measurement result is shown in TABLE-1 b low.

TABLE 1

| ARC RESISTANT MATERIAL | INTER-TERMINAL CURRENT | | |
|---|---|---|---|
| Ti | 40 A<br>NO | 50 A<br>NO | 60 A<br>NO* |

*An occurrence of the arc discharge cannot be confirmed since the terminals are fused to increase the separating speed.

The result shown in TABLE-1 confirms that Ti does not cause an arc discharge to occur even in the conditions that the inter-terminal voltage is DC36V and the inter-terminal current is 40 to 60A and has a considerably good arc resistance. It is apparent from the above result that no arc discharge occurs when the inter-terminal voltage is below DC36V and the inter-terminal current is below 40A.

A similar result (no arc discharge) was obtained when terminal models (width of about 30 mm) made of a Ti/Cu-alloy clad material were separated in conditions that the inter-terminal voltage is DC36V, the inter-terminal current is 50A and the separating speed is 100 mm/min. while titanium parts thereof, i.e. final contact portions thereof were held in sliding contact. The properties of the Ti/Cu-alloy used in the experiment was as follows:

Ti:purity of 99.5 mass %, thickness of 0.05 mm

Cu-alloy:MSP1 produc d by Mitsubishi Sindo: Cu: 99.3 mass %, Mg: 0.7 mass %, P: 0.005 mass % thickness of 0.35 nm

REFERENCE EXAMPLE

Using round bar-shaped models made of tungsten and pure copper, an occurrence of an arc discharge was confirmed in the same way as in EXAMPLE 1 except that the inter-terminal current was varied. A measurement result is shown n TABLE-2.

TABLE 2

| ARC RESISTANCE MATERIAL | INTER-TERMINAL CURRENT | | |
|---|---|---|---|
| Pure Copper | 20 A | 30 A | 40 A |
| | NO | NO | YES |
| Tungsten | 10 A | 20 A | 30 A |
| | NO | NO | YES |

(inter-terminal voltage = DC36 V, separating speed = 100 mm/min.)

It is apparent from TABLE-2 that an arc discharge occurs in the case of pure copper when the inter-terminal voltage is 36V and the Inter-terminal current becomes 40A or higher and in the case of tungsten when the inter-terminal terminal current is 30A or higher. This result shows that the inventive arc resistant terminal has a better arc discharge resisting property than the arc resistant terminal using tungsten as a resistance element.

According to the present invention, the inventive arc resistant terminal can effectively suppress an occurrence of an arc discharge even in such a condition that the base metal of the terminal creates an arc discharge. Particularly, even in such a condition that an arc discharge is likely to occur: the inter-terminal voltage is DC36V and the inter-terminal current is 30A to 60A, an occurrence of an arc discharge can be suppressed regardless of the kind of the base metal of the terminal.

This application is based on Japanese Patent application No.2002-321,240 filed on Nov. 5, 2002, the contents of which are hereby incorporated by reference.

What is claimed is:

1. A terminal and a counterpart terminal to be electrically connected with each other at contact portions thereof by engaging each other, each of the terminal and the counterpart terminal, comprising:

a conductive portion of electrically conductive material; and a final contact portion which is in contact with the counterpart terminal or the terminal at a final stage while the terminal is being disengaged from the counterpart terminal, the last contact portion is made of an arc suppressive material, most of its content being titanium in terms of mass percent.

2. A terminal according to claim 1, wherein the titanium content of the arc suppressive material is 95 mass percent or higher.

3. A terminal according to claim 1, wherein the titaniun content of the arc suppressive material is 99 mass percent or higher.

4. A terminal according to claim 1, wherein the conductive portion of the terminal is made of any one of copper, a copper alloy, aluminum or an aluminum alloy.

5. A terminal according to claim 4, wherein the conductive portion of the terminal is made of any one of Cu—Mg—P alloy, a Cu—Fe—P alloy, a Cu—Sn alloy, Cu—Sn—Fe—P alloy and Cu—Zn alloy.

6. A terminal according to claim 4, wherein the conductive portion of the terminal is made of any one of Al—Cu alloy, Al—Si alloy, and Al—Cu—Si alloy.

7. A pair of terminals including a male terminal and a female terminal which engage each other to establish an electrical connection, each of the terminals, comprising:

a conductive portion of electrically conductive material to be in contact with the counterpart terminal while the terminals are engaged each other; and a final contact portion which is in contact with the counterpart terminal at a final stage while the terminal is being disengaged from the counterpart terminal, the last contact portion is made of an are suppressive material, most of its content in terms of mass percent being titanium.

8. A pair of terminals according to claim 7, wherein the titanium content of the arc suppressive material is 95 mass percent or higher.

9. A pair of terminals according to claim 7, wherein the conductive portion of each terminal is made of any one of copper, a copper alloy, aluminum or an aluminum alloy.

10. A pair of terminals according to claim 7, wherein each terminal is formed by a stripe clad material including a layer of arc suppressive material which is integral with conductive material, the stripe clad material being bent into a suitable shape.

11. A pair of terminals according to claim 7, wherein the female terminal includes a leading end portion defining an opening through which the male terminal is coupled to the female terminal, and an arc suppressive layer is formed on an inner wall of the leading end portion.

12. A pair of terminals according to claim 7, wherein the male terminal includes a tab portion and an arc suppressive portion which is integrally attached to the tab portion to cover a lead portion of the tab portion.

13. A pair of terminals according to claim 12, wherein the tab portion and the arc suppressive portion are tapered to be thinner toward their end such that the arc suppressive portion covers the end portion of the tab portion.

14. A connector for use in an automotive vehicle and including a terminal and a counterpart terminal to be electrically connected with each other at contact portions thereof by engaging each other, each of the terminal and the counterpart terminal, comprising:

a conductive portion of electrically conductive material; and a final contact portion which is in contact with the counterpart terminal or the terminal at a final stage while the terminal is being disengaged from the counterpart terminal, the last contact portion is made of an arc suppressive material, most of its content being titanium in terms of mass percent.

15. A connector according to claim 14, wherein the titanium content of the arc resistant suppressive material is 95 mass percent or higher.

16. A connector according to claim 14, wherein the conductive portion of the terminal is made of any one of copper, a copper alloy, aluminum or an aluminum alloy.

* * * * *